US005117564A

United States Patent [19]

Taguchi et al.

[11] Patent Number: 5,117,564

[45] Date of Patent: Jun. 2, 1992

[54] CONTINUOUS VACUUM TREATMENT SYSTEM

[75] Inventors: Toshio Taguchi; Hajime Okita, both of Hiroshima, Japan

[73] Assignee: Mitsubishi Jukogyo Kabushiki Kaisha, Tokyo, Japan

[21] Appl. No.: 517,036

[22] Filed: May 1, 1990

[30] Foreign Application Priority Data

May 9, 1989 [JP] Japan ..... 1-114073
Mar. 6, 1990 [JP] Japan ..... 2-52812

[51] Int. Cl.[5] ..... F26B 13/30

[52] U.S. Cl. ..... 34/92; 432/152; 432/128; 34/5

[58] Field of Search ..... 34/5, 92, 204, 208, 34/216, 217, 242; 432/128, 152, 153, 205, 241, 242

[56] References Cited

U.S. PATENT DOCUMENTS 1,396,859 11/1921 Long .
2,858,795 11/1958 Walker .
3,071,356 1/1963 Duffy ..... 432/128 X
3,174,229 3/1965 Stokes et al. .
3,234,661 2/1966 Nerge .
3,286,365 11/1966 Hackenberg ..... 34/92
3,316,655 5/1967 Bocciardo ..... 34/92
3,415,075 12/1968 Petmulder et al. .
3,531,871 10/1970 Sahara .
3,864,840 2/1975 Baskin ..... 34/92 X
4,104,805 8/1978 Margittai ..... 34/97 X
4,106,894 8/1978 Bobleter et al. ..... 432/5 X
4,127,947 12/1978 Webb et al. ..... 34/92
4,421,020 12/1983 Gross ..... 34/92 X
4,518,353 5/1985 Banno et al. ..... 432/152 X
4,718,847 1/1988 Manson ..... 432/241

FOREIGN PATENT DOCUMENTS 1135830 8/1962 Fed. Rep. of Germany .
1912371 10/1970 Fed. Rep. of Germany .
2420401 3/1978 France .

*Primary Examiner*—Henry A. Bennett
*Assistant Examiner*—C. Kilner
*Attorney, Agent, or Firm*—Wenderoth, Lind & Ponack

[57] ABSTRACT

An improved vacuum treatment system includes containers for accommodating articles to be treated, a tunnel-like casing in which a plurality of the casings can move contiguously, a driving device for making the containers move in the casing, a plurality of evacuation ducts open to the casing at a plurality of locations, sealing devices for sealing the clearance between the outer surfaces of the containers and the inner surface of the casing at the positions between the openings, and an evacuation facility for evacuating the inside of the casings through the evacuation ducts. The locations of the evacuation ducts closest to the opposite ends of the casing are spaced apart from the ends of the casing by distances greater than the length of the container. The intervals between the locations of the evacuation ducts are preferably longer than the length of the container. There can also be provided a plurality of tunnel-like casings, the insides of which are evacuated by a single evacuation facility through the evacuation ducts.

10 Claims, 12 Drawing Sheets

CONTINUOUS VACUUM TREATMENT SYSTEM

BACKGROUND OF THE INVENTION

1. Field of the Invention

The present invention relates to a continuous vacuum treatment system such as a system for continuously vacuum-drying fabric yarns kept in spindle-shaped blocks after dying them, a high-speed drying system for ceramic products or vacuum-dried foods, a system for continuously vacuum-depositing a film of different material on a surface of an unbendable or unwindable article such as a sheet of glass or a thick plastic plate, or the like.

2. Description of the Prior Art

One example of a heretofore known system for drying articles by making use of hot air is shown in vertical cross section in FIG. 18. In this figure, reference numeral 03 designates a casing, numeral 04 designates a drainboard-like intermediate wall provided with the casing 03, numeral 05 designates a feed pipe for feeding hot air 07, and numeral 06 designates an exhaust gas pipe for exhausting cold air 08 after drying. In the hot air drying system constructed in the above-described manner, articles to be dried 01 accommodated in containers 02 having drainboard-like bottom walls are charged, and hot air 07 is fed thereto from a hot air generator not shown. The articles to be dried 01 are heated and dried by the hot air 07 blowing through interstices of the articles to be dried 01.

The drying system relying upon hot air gives rise to the problems indicated. That is, because a packed condition of the articles to be dried 01 within the container 02 is liable to occur, there exists a location where hot air 07 can well blow therethrough and a location where it can hardly blow therethrough, resulting in poor quality (insufficient drying) or an elongation of the time necessitated for drying. Therefore, if the temperature of hot air is raised in order to shorten the drying time, sometimes the articles to be dried 01 would be changed in quality.

For the purpose of resolving the aforementioned problems, a vacuum drying system as shown in FIG. 19 has been devised. In this figure, reference numeral 013 designates a vacuum chamber, numeral 013*a* designates a manhole, numeral 015 designates an evacuation device for evacuating the air inside of the vacuum chamber 013 numeral 016 designates an evacuation duct for connecting the evacuation device 015 with the vacuum chamber 013, and numeral 017 designates a heat source of a dielectric heating type or the like. Articles to be dried 011 are charged within the containers 012 at the outside of the vacuum chamber 013, they are accommodated jointly with the containers 012 within the vacuum chamber 013, after the manhole 013*a* has been closed the inside of the vacuum chamber 013 is evacuated by the evacuation device 015, and the articles to be dried 011 are heated and dried by the heat source 017 of a dielectric heating type or the like. After drying is completed, the inside of the vacuum chamber 013 is returned to the atmosphere, and after the containers 012 have been taken out and articles to be dried 011 have been recharged therein, the containers are returned into the vacuum chamber, and these steps of processing are repeatedly executed. An efficiency rate of operation is 50% or less.

In the above-described vacuum drying system in the prior art, since the system is of batch type wherein the steps of charging, evacuation, drying, pressure recovery and take-out are repeated, an efficiency rate of operation is as low as 50% or less. Also, in the process relying upon hot air a treatment time for one batch is long compared to the vacuum drying system, and also uneven drying as well as a degradation in quality caused by local overheating would arise.

SUMMARY OF THE INVENTION

It is therefore one object of the present invention to provide an improved continuous vacuum treatment system, in which an efficiency rate of operation is enhanced without deteriorating treated articles.

According to a first feature of the present invention, there is provided a continuous vacuum treatment system comprising containers for accommodating articles to be treated, a tunnel-like casing in which a plurality of the aforementioned containers can move contiguously, a driving device for making the aforementioned containers move in the same casing, a plurality of evacuation ducts open to the casing at positions spared from the ends of the casing by distances greater than the length of the aforementioned container, seal devices for sealing the clearance between the outer surfaces of the containers and the inner surface of the casing at positions between the aforementioned plurality of openings, and an evacuation facility for evacuating the inside of the casing through the plurality of evacuation ducts.

According to a second feature of the present invention, there is provided a continuous vacuum treatment system comprising containers for accommodating articles to be treated, a plurality of tunnel-like casings in which a plurality of the aforementioned containers can move contiguously, a driving device for making the aforementioned containers move in the same casing, evacuation ducts respectively open at a plurality of locations on the plurality of casings, seal devices for sealing the clearances between the outer surfaces of the containers and the inner surfaces of the casings at positions between the aforementioned plurality of openings, and a single evacuation facility for evacuating the inside of the plurality of casings through the aforementioned evacuation ducts.

According to a third feature of the present invention, there is provided a continuous vacuum treatment system comprising containers for accommodating articles to be treated, each of which containers has throughholes in its walls transverse of its direction of movement, a tunnel-like casing in which a plurality of the aforementioned casings can move contiguously, a driving device for making the aforementioned containers move in the same casing, a plurality of evacuation ducts open to the aforementioned casing at intervals longer than the length of the aforementioned container, seal devices for sealing the clearances between the outer surfaces of the containers and the inner surface of the casing at the positions between the aforementioned plurality of openings, and an evacuation facility for evacuating the inside of the casing in a stepwise manner through the aforementioned plurality of evacuation ducts.

According to the first aspect of the present invention as described above, a plurality of compartments partitioned by the seal devices between the inner surface of the casing and the outside surfaces of the containers, are formed within the casing. Among these compartments, the most outside compartment would move to a space communicating with the evacuation duct after it has been subjected to atmospheric pressure as a result of movement of the containers, and it would be evacuated by the evacuation facility Therefore, a container accommodating articles to be treated can be continuously moved from the atmosphere to a vacuum chamber and then from the vacuum chamber to the atmosphere, and during the period when it passes through the vacuum chamber, the articles to be treated can be vacuum-treated. In this case, the evacuation facility is only required to evacuate only the air within the container that is brought into the casing as a result of movement of the containers.

Also, according to the second aspect of the present invention as described above, in the respective casings, a plurality of compartments, partitioned by the seal devices between the inner surface of the casing and the outer surfaces of the containers, are formed within each casing. And, the most outside compartment would move to a space communicating with the evacuation duct after it has been subjected to atmospheric pressure as a result of movement of the containers, and it would be evacuated by the evacuation facility. Therefore, a container accommodating articles to be treated can be continuously moved from the atmosphere to a vacuum chamber and then from the vacuum chamber to the atmosphere, and during the period when it passes through the vacuum chamber, the articles to be treated can be vacuum-treated. In this case also, the evacuation facility evacuates only the air within the container that is brought into the casing as a result of movement of the containers. Hence, by successively offsetting the timing under which the containers in the plurality of casings are moved, the plurality of casings can be evacuated by means of a single evacuation facility without increasing an evacuation capacity of the evacuation facility.

Furthermore, according to a third aspect of the present invention as described above, since a plurality of compartments partitioned by the plurality of seal devices between the inner surface of the casing and the outer surfaces of the casing are formed within a vacuum treatment system, if the respective compartments are evacuated in a stepwise manner by the evacuation facility through the ducts provided on the casing, then the inside of the casing is reduced in pressure in a stepwise manner from the atmosphere, and at the central portion within the system is obtained a vacuum chamber. Therefore, the containers accommodating articles to be treated are continuously moved from the atmosphere into the vacuum chamber and then from the vacuum chamber to the atmosphere, and during the period when the container passes through the vacuum chamber, the articles to be treated can be vacuum-treated.

The above-mentioned and other objects, features and advantages of the present invention will become more apparent by referring to the following description of preferred embodiments of the invention taken in conjunction with the accompanying drawings.

DETAILED DESCRIPTION OF THE PREFERRED EMBODIMENT

Figure 1:
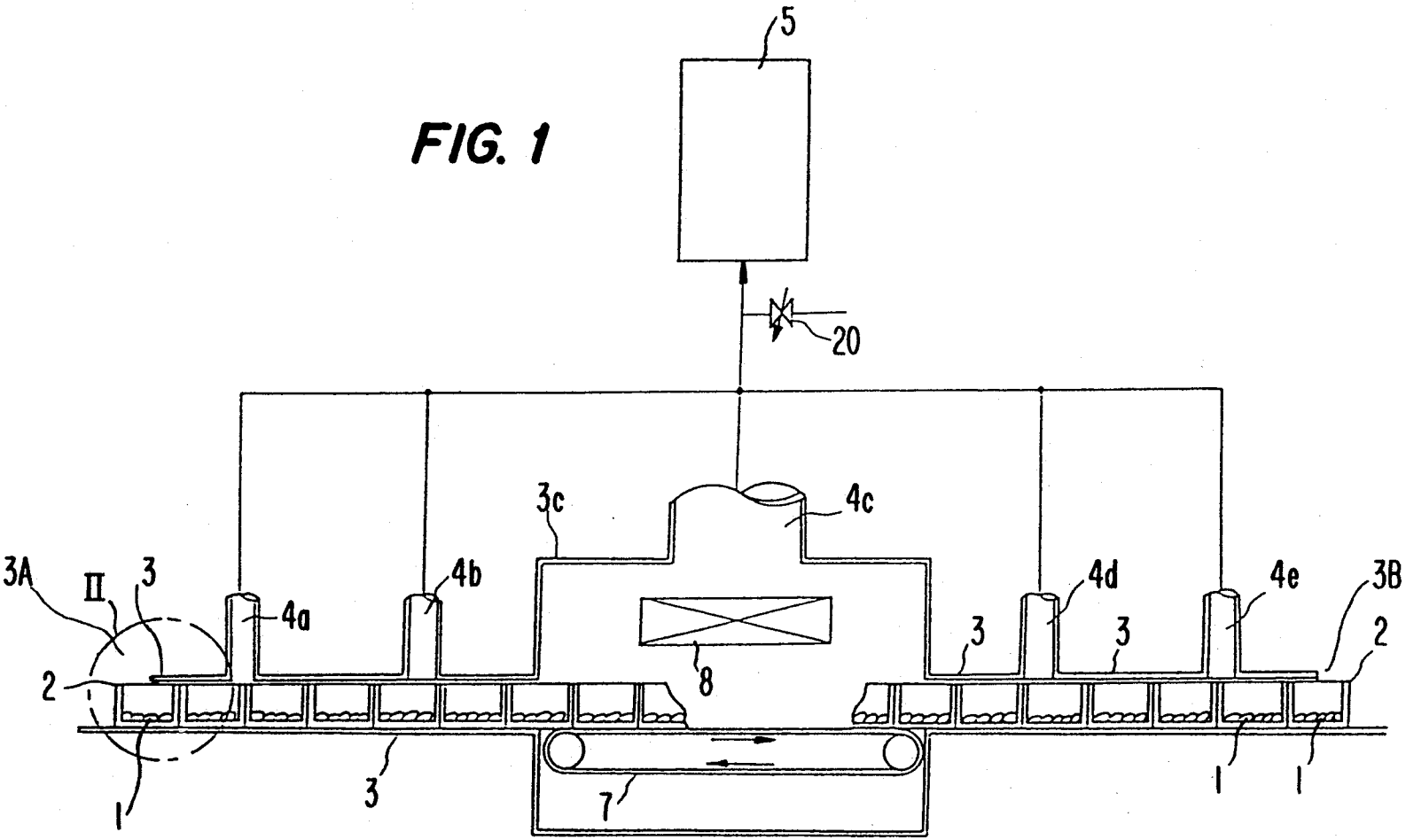
FIG. 1 is a longitudinal cross-sectional view of a first preferred embodiment of the present invention.
Figure 2:
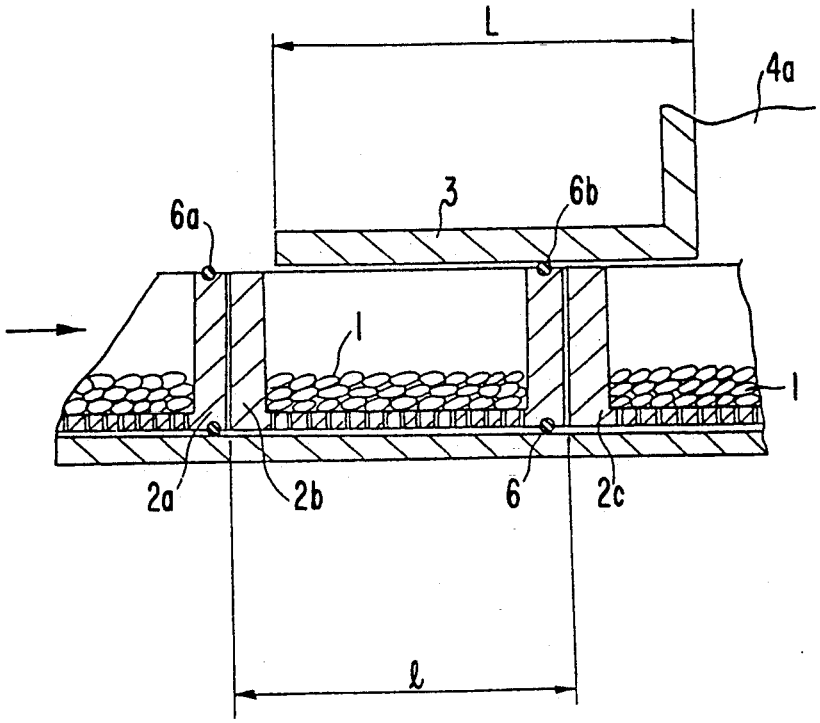
FIG. 2 is an enlarged view of a portion encircled by a dash-dot line II in FIG. 1.

At first, the first preferred embodiment of the present invention will be described with reference to FIGS. 1 and 2. In these figures, reference numeral 3 designates a linear tunnel-like casing having a charging section 3A for containers and a discharging section 3B at its opposite ends, and a plurality of containers 2, **2*a*, 2*b* and 2*c* can move continuously through the inside of the casing 3. The bottoms of these containers 2, 2*a*, 2*b* and 2*c* are formed in a drainboard-like manner, and within the containers are accommodated, for instance, articles to be dried 1. Reference numerals 4*a*, 4*b*, 4*c*, 4*d* and 4*e* designate a plurality of (five, in the illustrated example) evacuation ducts, and the distance L (See FIG. 2) from the respective ends of the casing 3 to the most outside evacuation ducts 4*a* and 4*e*, respectively, are longer than the length l of the respective containers 2, 2*a*, 2*b* and 2*c*. Reference numerals 6, 6*a* and 6*b* designate slide O-rings provided around the peripheries of the front walls of the containers 2, 2*a*, 2*b* and 2*c*, which seal the clearances between the outer surfaces of the containers 2, 2*a*, 2*b* and 2*c* and the inner surface of the casing 3, reference numeral 5 designates a vacuum evacuation apparatus, whose inlet port communicates with the evacuation ducts 4*a*, 4*b*, 4*c*, 4*d* and 4*e*. Reference numeral 20 designates a leak valve provided at the inlet port of the vacuum evacuation apparatus 5. The central portion of the casing 3 where the evacuation duct 4*c* opens is enlarged to form a vacuum treatment chamber 3*c*. Reference numerals 7 and 8 respectively designate a belt conveyor and an induction heating device provided within the vacuum treatment chamber 3*c***.

In this preferred embodiment, the containers 2, **2*a*, 2*b* and 2*c* accommodating articles to be dried 1 are charged into the casing 3 through the charging section 3A of the vacuum treatment system, and they are fed into the casing in a contiguous disposition by means of a driving device not shown. At this time, while the container 2b is open to the atmosphere when the container 2b has advanced up to the position where the slide O-ring 6a comes into contact with the inner surface of the casing 3 as a result of movement, the container 2b is held at the atmospheric pressure because the path between the evacuation duct 4a and the container 2b is blocked by the slide O-ring 6b. Thereafter, the container 2b moves further, and when it has advanced up to the position designated by reference numeral 2c, since the container 2c communicates with the duct 4a, the air inside of the container 2c is evacuated and assumes a vacuum state. At this time, since the path between the atmosphere and the container 2b is blocked by the slide O-ring 6b, only the air brought in as enclosed within the container 2b** is evacuated.

In the vacuum treatment chamber 3c, while the containers 2, 2a, 2b and 2c having been brought in as described above are moving on the conveyor 7, the articles to be dried 1 accommodated within the containers are heated by a heat source such as the induction heating device 8 or the like, and they are vacuum-dried. In this case, since the bottoms of the containers 2, 2a, 2b and 2c are formed in a drainboard shape, moisture in the articles to be dried 1 is readily evaporated and removed. The containers 2, 2a, 2b and 2c accommodating the articles to be dried 1 which have been vacuum-dried, move further and are carried out into the atmosphere in a reverse manner to that in which they are carried in.

As described above, in the illustrated embodiment, an extremely simple structure can continuously introduce discontinuous articles from the atmosphere into a vacuum and thereafter again carry out the article continuously into the atmosphere, and moreover, the load applied to the vacuum evacuation apparatus 5 can be suppressed to a minimum. It is to be noted that while the pressure in the vacuum treatment chamber 3 would vary due to the fact that air brought into the vacuum system as a result of movement is evacuated, the pressure variation is small and does not become an issue because normally the volume of the vacuum treatment chamber 3c is sufficiently large as compared to the volume of one container. In addition, in the event that the pressure in the vacuum treatment chamber 3c becomes too low, and there occurs an inconvenience in view of vacuum treatment or in view of the operation of the vacuum evacuation apparatus, the pressure can be maintained at a necessary value by introducing the atmospheric air through the leak valve 20 provided at the piping on the inlet side of the vacuum evacuation apparatus.

Figure 3:
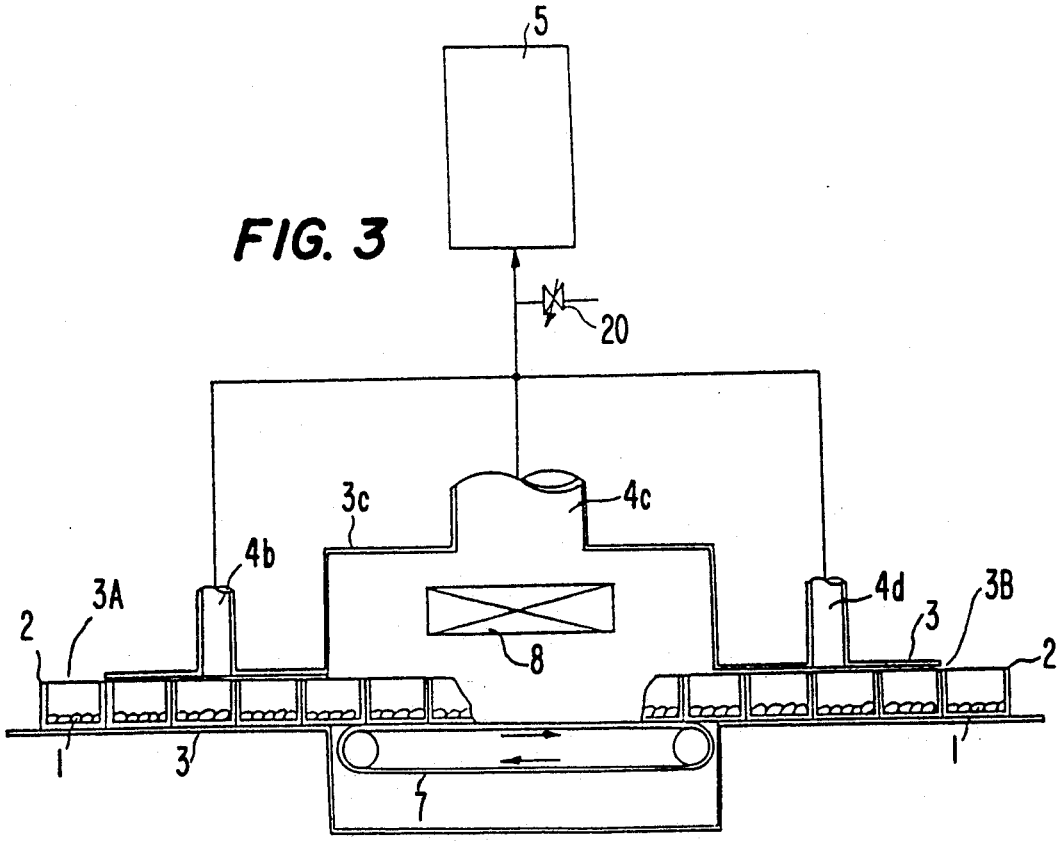
FIG. 3 is a longitudinal cross-sectional view of a second preferred embodiment of the present invention.

Next, a second preferred embodiment of the present invention will be described with reference to FIG. 3. The illustrated embodiment is also basically similar to the first preferred embodiment described above with reference to FIGS. 1 and 2, but in this embodiment only the evacuation ducts 4b and 4d are provided on the casing 3 for the charging section side 3A and the discharging section side 3b, respectively.

Figure 4:
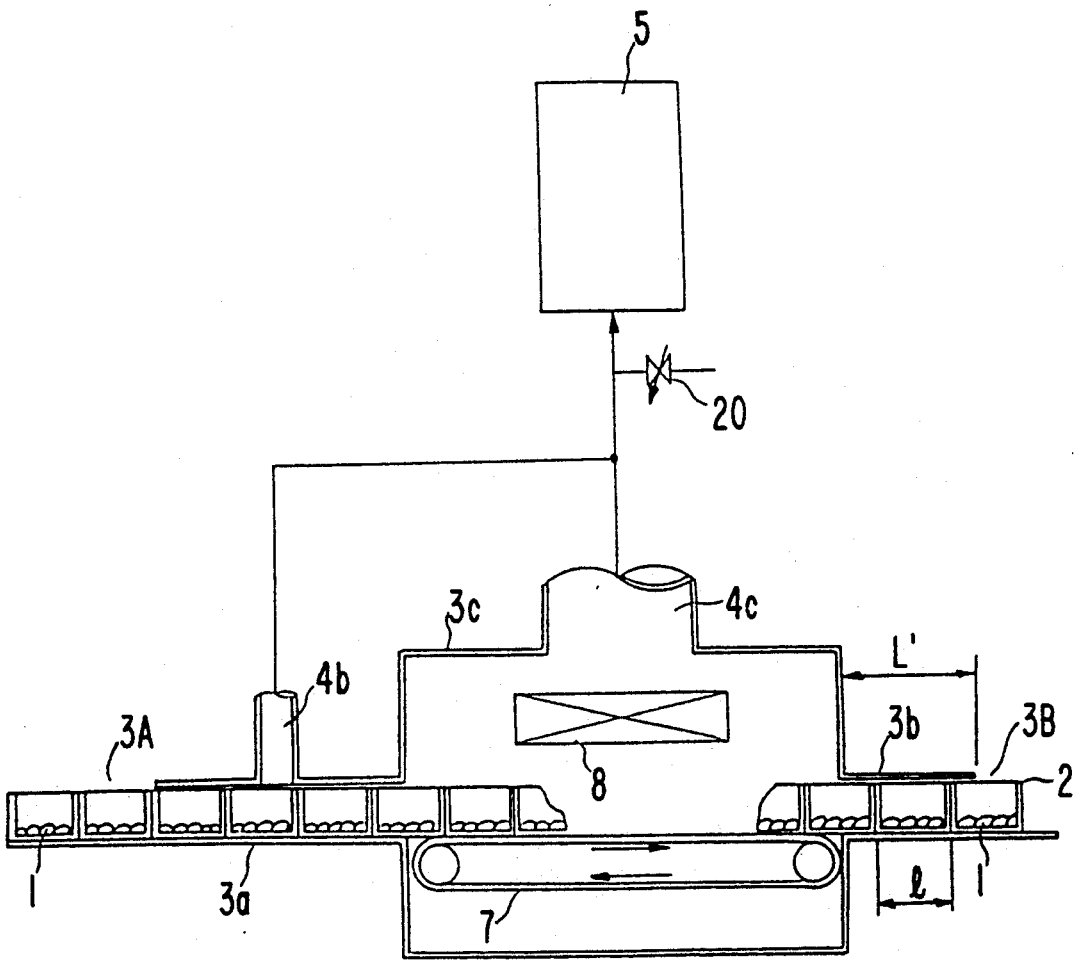
FIG. 4 is a longitudinal cross-sectional view of a third preferred embodiment of the present invention.

FIG. 4 is a longitudinal cross-sectional view showing a third preferred embodiment of the present invention. In this preferred embodiment, only an evacuation duct 4b is provided on the casing 3a on the side of the charging section 3A and an exhaust duct is not present on the casing 3b on the side of the discharging section 3B. Instead, the casing 3b on the side of the discharging section 3B has its length L' made sufficiently longer than the length l of one container.

Next, a fourth preferred embodiment of the present invention will be explained with reference to FIG. 5. In the illustrated embodiment, multiple sets (three sets in the illustrated example) of continuous vacuum treatment systems according to the first preferred embodiment as described above with reference to FIGS. 1 and 2 are installed. And, evacuation ducts 4a, 4b, . . . , 4e, 4a', 4b', . . . , 4e', 4a'', 4b'', . . . , 4e'', opening at a plurality of locations on the respective ones of the walls of the respective casings 3, 3' and 3'' all communicate commonly with an inlet port of a single vacuum evacuation apparatus 5.

While the single vacuum evacuation apparatus evacuates successively the air in the containers brought into the casings 3, 3' and 3'' as a result of movement of the containers 2, in this particular preferred embodiment, the timing of movement of the containers 2 in the respective ones of the plurality of casings 3, 3' and 3'' is such that two or more containers 2 may not simultaneously communicate with the evacuation ducts 4a, 4a' and 4a'', and thereby, the evacuation capacity of the vacuum evacuation apparatus 5 can be made equal to that in the case where there is only one casing. In this way, discontinuous articles can be fed from and exhausted to the atmosphere continuously. Accordingly, an efficiency of vacuum treatment of discontinuous articles can be, improved, and a productivity could be enhanced to twice that or more of systems of a similar scale in the prior art. Furthermore, accompanying continuous version of vacuum treatment, continuous version including preceding and succeeding steps thereof also has become possible.

Figure 6:
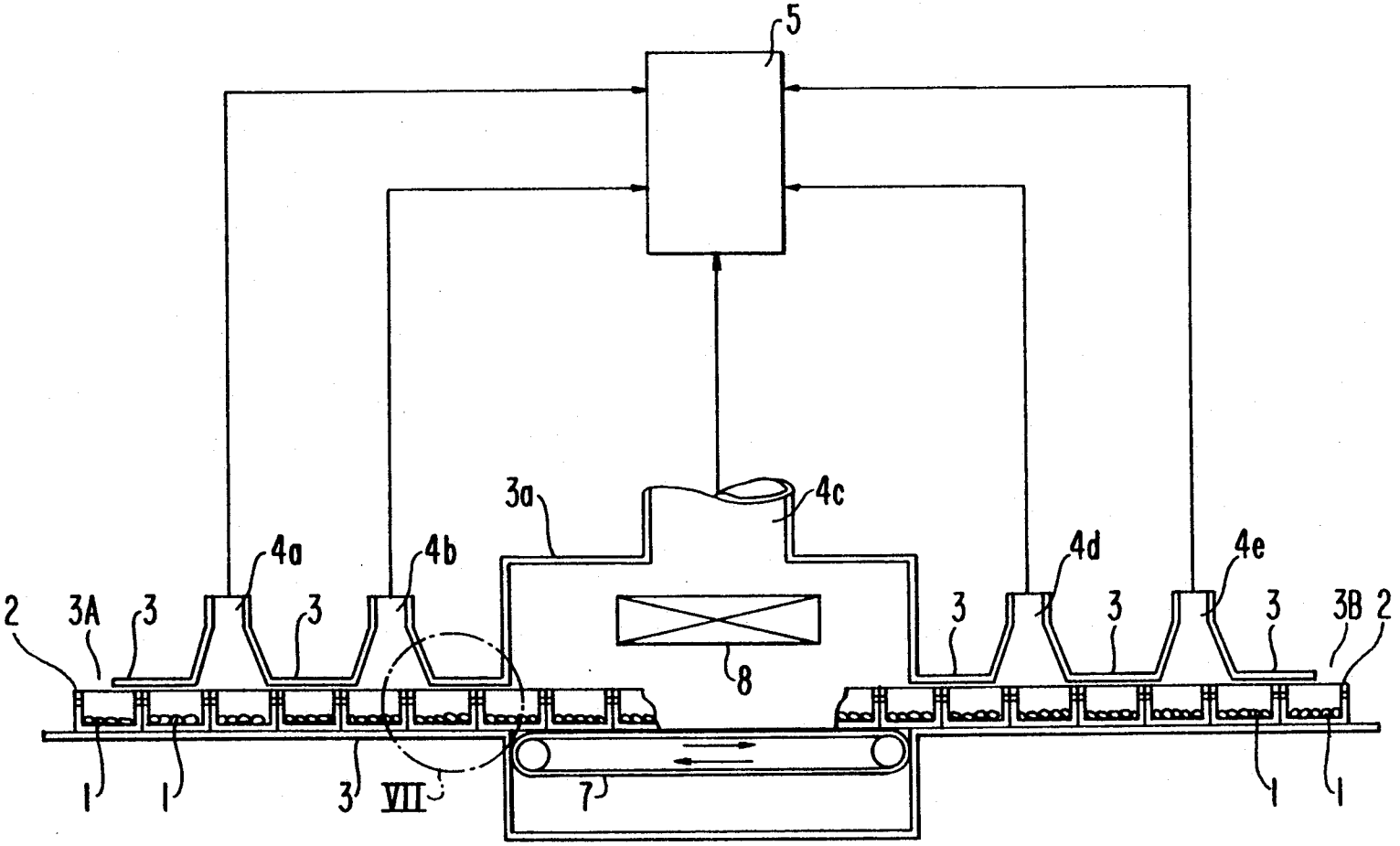
FIG. 6 is a longitudinal cross-sectional view of a fifth preferred embodiment of the present invention.
Figure 7:
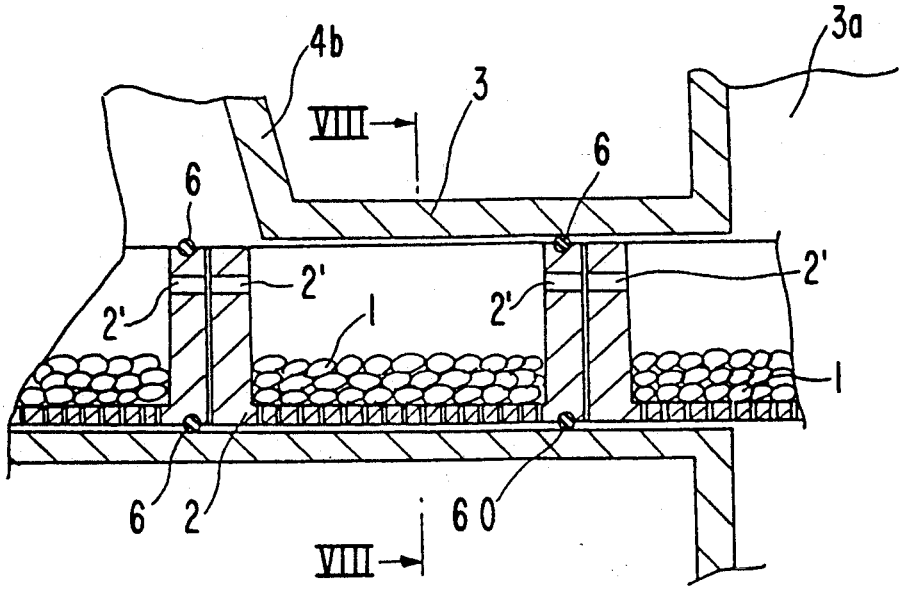
FIG. 7 is an enlarged view of a portion encircled by a dash-dot line VII in FIG. 6.
Figure 8:
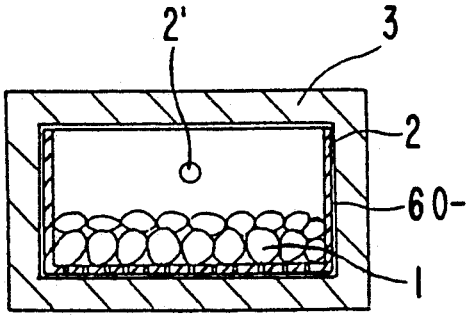
FIG. 8 is a transverse cross-sectional view taken along a line VIII—VIII in FIG. 7.

Now a fifth preferred embodiment of the present invention will be described with reference to FIGS. 6 to 8. FIG. 6 is a longitudinal cross-sectional view showing the fifth preferred embodiment, FIG. 7 is an enlarged view of a portion encircled by a dash-dot line VII in FIG. 6, and FIG. 8 is a transverse cross-sectional view taken along a line VIII—VIII in FIG. 7.

In these figures, reference numeral 3 designates a linear tunnel-like casing having at its opposite ends a charging section 3A and a discharging section 3B for containers 2, and a plurality of containers 2 can move contiguously through the inside of the casing 3. Each of these containers 2 has small-diameter through-holes 2' in the front and rear walls transverse of the direction of movement, and their bottoms are formed in a drainboard shape. Reference numerals 4a, 4b, 4c, 4d and 4e designate a plurality of (five, in the illustrated example) evacuation ducts, which open at the wall of the casing 3 at intervals larger than the length of the containers 2. Reference numeral 6 designates an O-ring provided around the periphery of the front wall of the aforementioned container 2, which seals the clearance between the outer surface of the same container 2 and the inner surface of the casing 3. Reference numeral 5 designates a vacuum evacuation apparatus, whose inlet port communicates with the above-mentioned evacuation ducts 4a, 4b, 4c, 4d and 4e. The portion at the center of the casing 3 where the evacuation duct 4c opens, is enlarged to form a vacuum treatment chamber 3a. Reference numerals 7 and 8, respectively, designates a belt conveyor and an induction heating device provided within the same vacuum treatment chamber 3a.

In such a vacuum treatment system, containers 2 accommodating articles to be dried 1 are charged into the casing 3 from the charging section 3A on one side of the vacuum treatment system, then they are moved contiguously through the inside of the casing by means of a driving device not shown, and they are discharged from the casing 3 through the discharging section 3B on the other side. While the containers 2 are successively moved, they are reduced in pressure up to, for example, about 400 Torr at the portion of the evacuation duct 4*a*, and as they are moved further, at the portion of the evacuation duct 4*b* they are reduced in pressure up to, for example, about 150 Torr and further up to about 10 Torr in the vacuum treatment chamber 3*a*. In this vacuum treatment chamber 3*a*, while the containers 2 are being moved on the conveyor 7, the articles to be dried 1 accommodated within the containers are heated by a heat source such as the induction heating device 8, and thus they are vacuum-dried. In this case, since the bottom of the container 2 is formed in a drainboard shape, moisture is readily evaporated. The containers 2 accommodating the dried articles 1 move further, and as the pressure is sequentially recovered in a stepwise manner of 10 Torr→150 Torr→400 Torr→[Atmospheric pressure] in the reverse direction to that at the time of charging, they are discharged to the atmosphere.

In this particular embodiment, in order to suppress the pressure variation within the casing 3 (including the vacuum treatment chamber 3*a*), which is reduced in pressure in a stepwise manner, to a minimum, the structure as disclosed in the following is employed.

That is, the lengths of the tunnel-like casings (sealed portions thereof) between the charging section and the initial evacuation duct 4*a*, between the adjacent evacuation ducts (between 4*a* and 4*b*, between 4*b* and 3*a*(4*c*), between 3*a*(4*c*) and 4*d*, between 4*d* and 4*e*) and between the last evacuation duct 4*e* and the discharging section, are all longer than the length of the container 2. Accordingly, in every sealed section there always exists one or more containers 2, so that blow-through between the atmosphere and the evacuation duct as well as between the adjacent evacuation ducts can be prevented.

Figure 9:
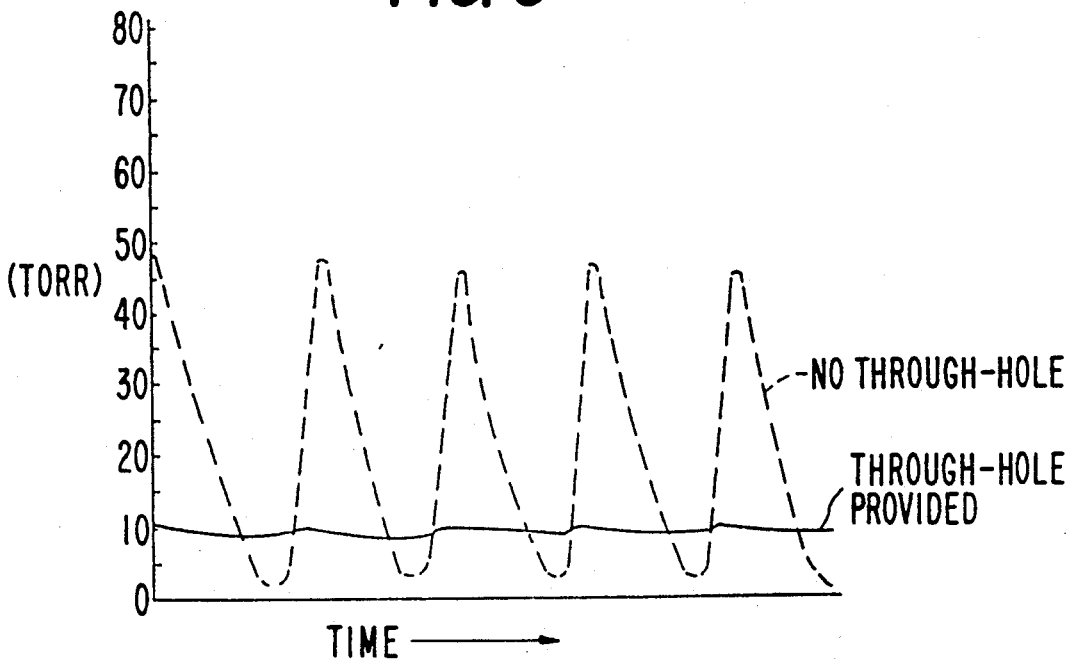
FIG. 9 is a diagram showing an operational feature of the same embodiment.

In addition, slide seal means such as an O-ring 6 is provided around the outer periphery of either one of the front and rear walls transverse of the direction of movement of the container 2 (the front wall in the illustrated example), and also small-diameter through-holes 2' are formed in the walls transverse of the direction of movement. These through-holes 2' are provided so that the pressure in the evacuation duct or the vacuum treatment chamber 3*a* may not abruptly fall nor rise when the O-ring 6 has been disengaged from the casing 3 and has entered in the evacuation duct or the vacuum treatment chamber 3*a* as a result of movement of the containers 2, but the container 2 may be gradually lowered (or raised) in pressure already when it is present in the sealed section of the casing 3 and, when it has entered the next evacuation duct section, the pressure may have already finished lowering (or rising). FIG. 9 comparatively illustrates the pressure variations within the vacuum treatment chamber 3*a* with respect to the case where these through-holes 2' are provided and the case where they are not provided.

Figure 10:
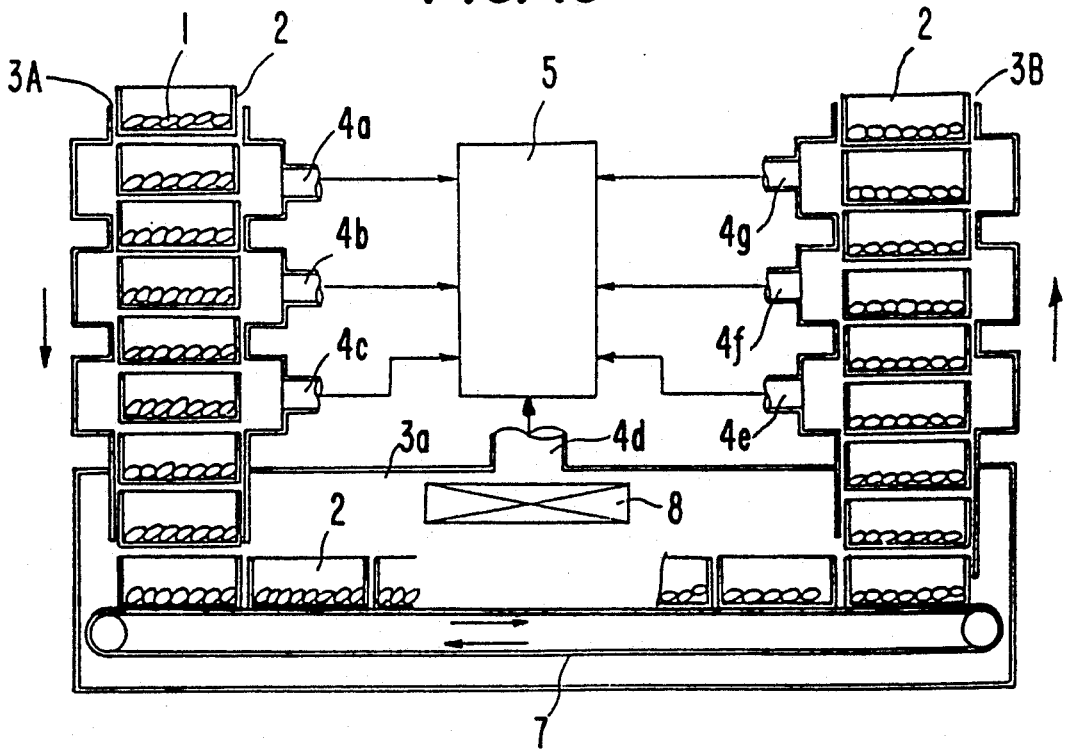
FIG. 10 is a longitudinal cross-sectional view of a sixth preferred embodiment of the present invention.

FIG. 10 is a longitudinal cross-sectional view showing a sixth preferred embodiment of the present invention. This preferred embodiment is employed in the case where the pressure in the vacuum treatment chamber 3*a* is lower than that in the above-described fifth preferred embodiment, or in the case where in the stepwise evacuation by means of the vacuum evacuation apparatus 5 the pressure differences between the successive vacuum stages are set smaller than those in the above-described fifth preferred embodiment, and the illustrated embodiment is one example of the continuous vacuum treatment system having the number of stages of the evacuation ducts increased. In this preferred embodiment, for the purpose of narrowing an installation area, a vacuum treatment chamber 3*a* is disposed horizontally, and on the opposite sides thereof are provided an upwardly extending charging-side casing section and an upwardly extending discharging-side casing section for the containers 2 to form a U-shaped casing 3 as a whole, so that the containers 2 can be charged and discharged in the vertical directions with respect to the vacuum treatment chamber 3*a*. In this preferred embodiment, through-holes are formed in the bottom walls of the containers 2, and thereby abrupt variations of the pressure in the casing 3 can be prevented.

Figure 11:
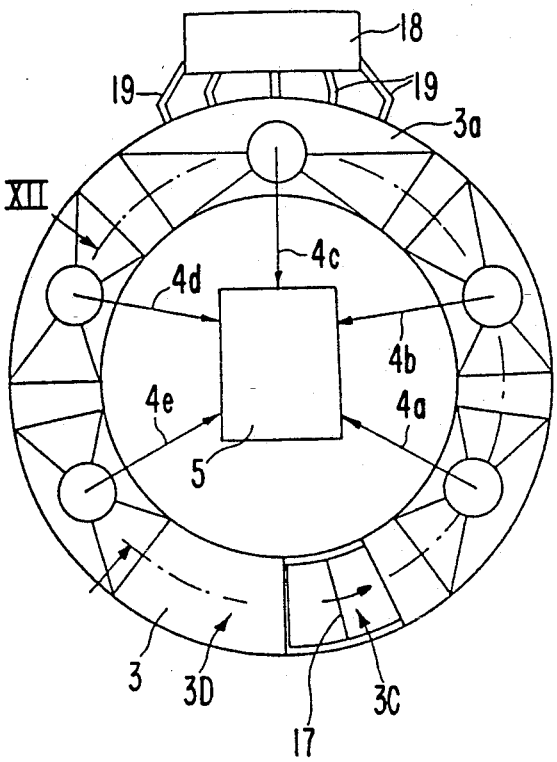
FIG. 11 is a plan view of a seventh preferred embodiment of the present invention.
Figure 12:
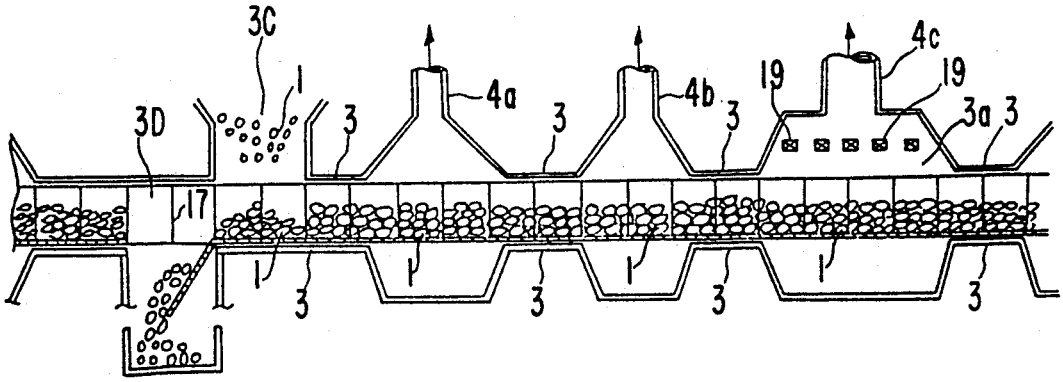
FIG. 12 is a developed cross-sectional side view taken along a dash-dot line XII—XII in FIG. 11.

FIG. 11 is a plan view showing a seventh preferred embodiment of the present invention, and FIG. 12 is a developed cross-sectional side view taken along a dash-dot line XII—XII in FIG. 11. This preferred embodiment relates to a circular-grate-shaped vacuum treatment system, in which a casing 3 is formed in an annular shape. The casing 3 is provided with a charging section 3C and a discharging section 3D adjacent to the same charging section 3C. According to such a modification, evacuation ducts 4*a*, 4*b*, 4*c*, 4*d* and 4*e* open at the annular casing 3 at intervals longer than a length of containers 17. In this preferred embodiment, articles to be treated 1 charged within a container 17 at the charging section 3C of the circular-grate-shaped vacuum treatment system are adapted to be discharged out of the container 17 at the discharging section 3D with the bottom of the container 17 opened, after they have been vacuum-treated while moving through the annular casing 3 over nearly one revolution jointly with the container 17. In the illustrated embodiment, a heat source 18 is provided outside of a vacuum treatment chamber 3*a*, and is adapted to feed hot air into the vacuum treatment chamber 3*a* through hot air feed pipes 19. It is to be noted that in the illustrated embodiment, the container 17 can be charged into or discharged from the annular casing 3 by moving the container 17 into the casing 3 or moving it from the inside of the casing 3 to the outside by means of pushers provided externally or internally of the annular casing 3.

Figure 13:
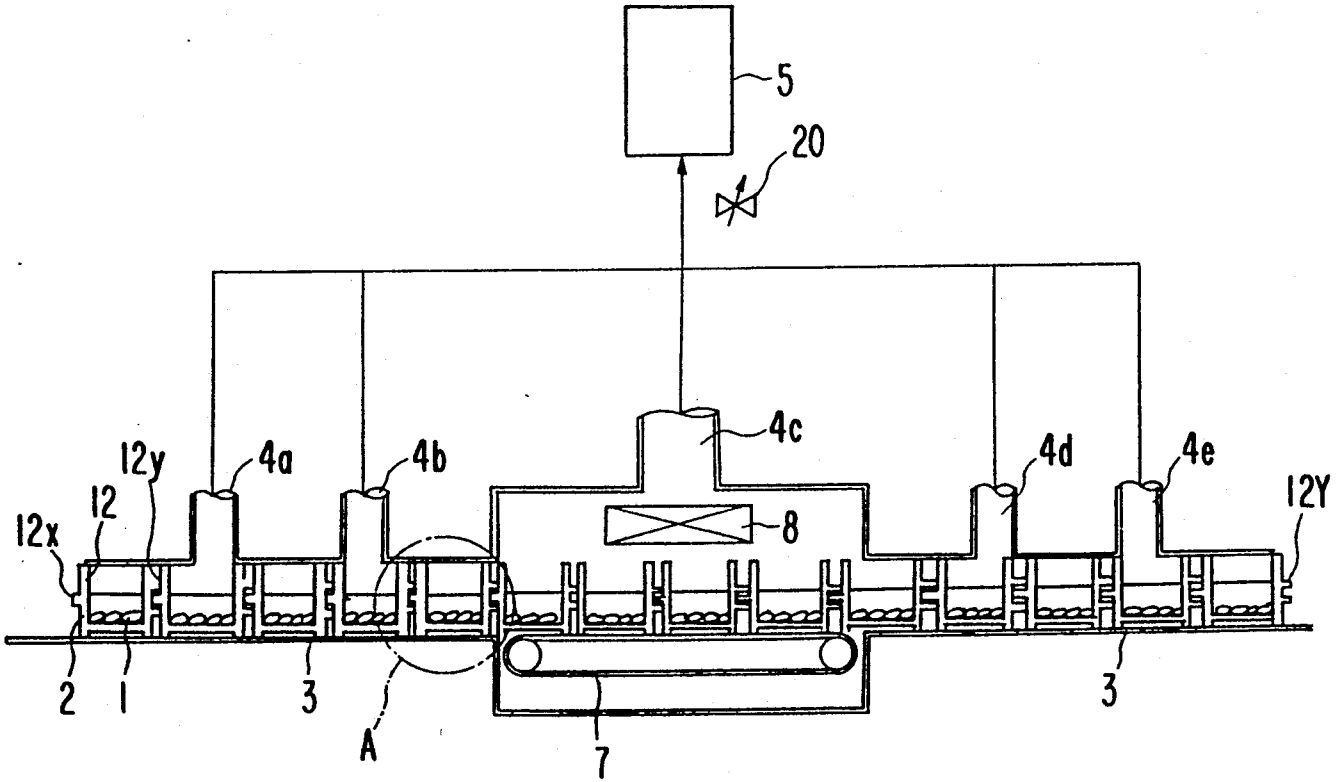
FIG. 13 is a longitudinal cross-sectional view of an eighth preferred embodiment of the present invention.
Figure 14:
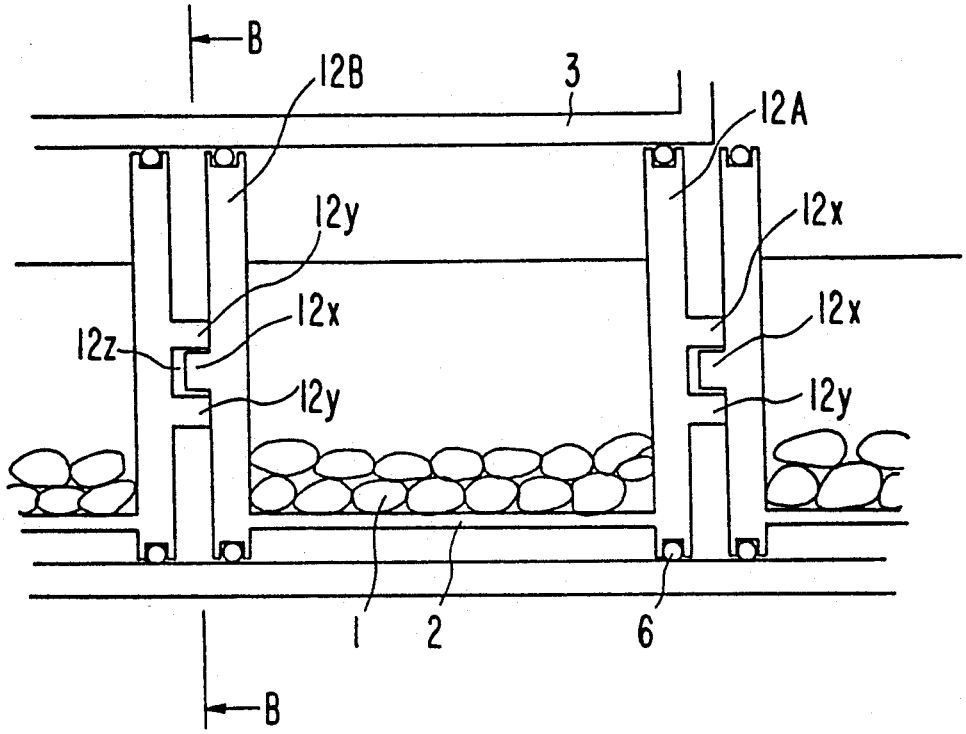
FIG. 14 is an enlarged view of a portion encircled by a line A in FIG. 13.
Figure 15:
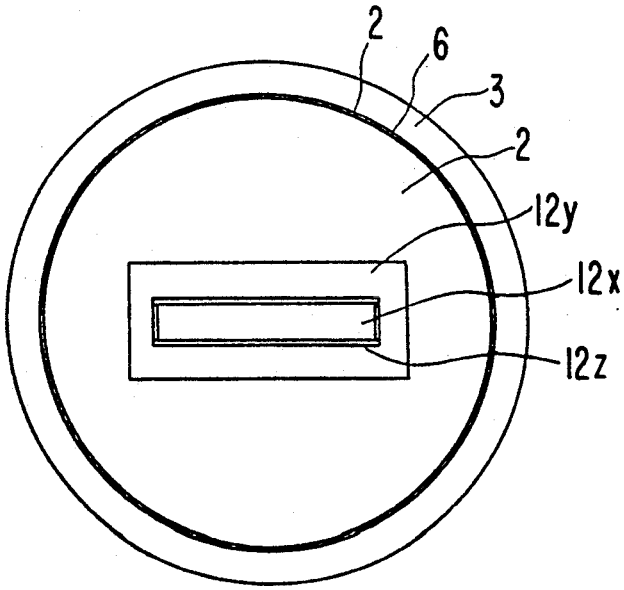
FIG. 15 is a transverse cross-sectional view taken along a line B—B in FIG. 14.

Now an eighth preferred embodiment of the present invention will be explained with reference to FIGS. 13, 14 and 15. In this preferred embodiment, the casing 3 in the above-described first preferred embodiment shown in FIGS. 1 and 2 and in the above-described fifth preferred embodiment shown in FIGS. 6 to 8 are modified into a cylindrical shape, and the containers 2 moving in the casing 3 are also modified into a cylindrical shape. On a front surface of a circular front wall 12A transverse of the direction of movement of the container 2 is formed a protrusion 12Y having a rectangular bore 12Z elongated in the horizontal direction, and also on a rear surface of a circular rear wall 12B transverse of the direction of movement of the container 2 is formed a horizontal rectangular protrusion 12X of a size adapted to fit in the rectangular bore 12Z at the position corresponding to the bore 12Z.

The plurality of containers 2 accommodating articles to be dried 1 therein would move contiguously along the cylindrical casing 3, and during this movement, since the protrusion 12X of the container 2 on the front side is held inserted in the bore 12Z of the container 2 on the rear side, relative rotation between these two adjacent containers 2, 2 can be prevented by the fitting engagement of the protrusion 12X and the bore 12Z.

It is to be noted that in this preferred embodiment, in place of the above-described engagement between the protrusion 12X and the bore 12Z, a modification could be made such that one of the front and rear wall surfaces of the container 2 is convex and the other of the wall surfaces is concave and relative rotation between the containers 2 may be prevented by an engagement between the concave and convex curved wall surfaces of the adjacent containers 2, 2.

Figure 5:
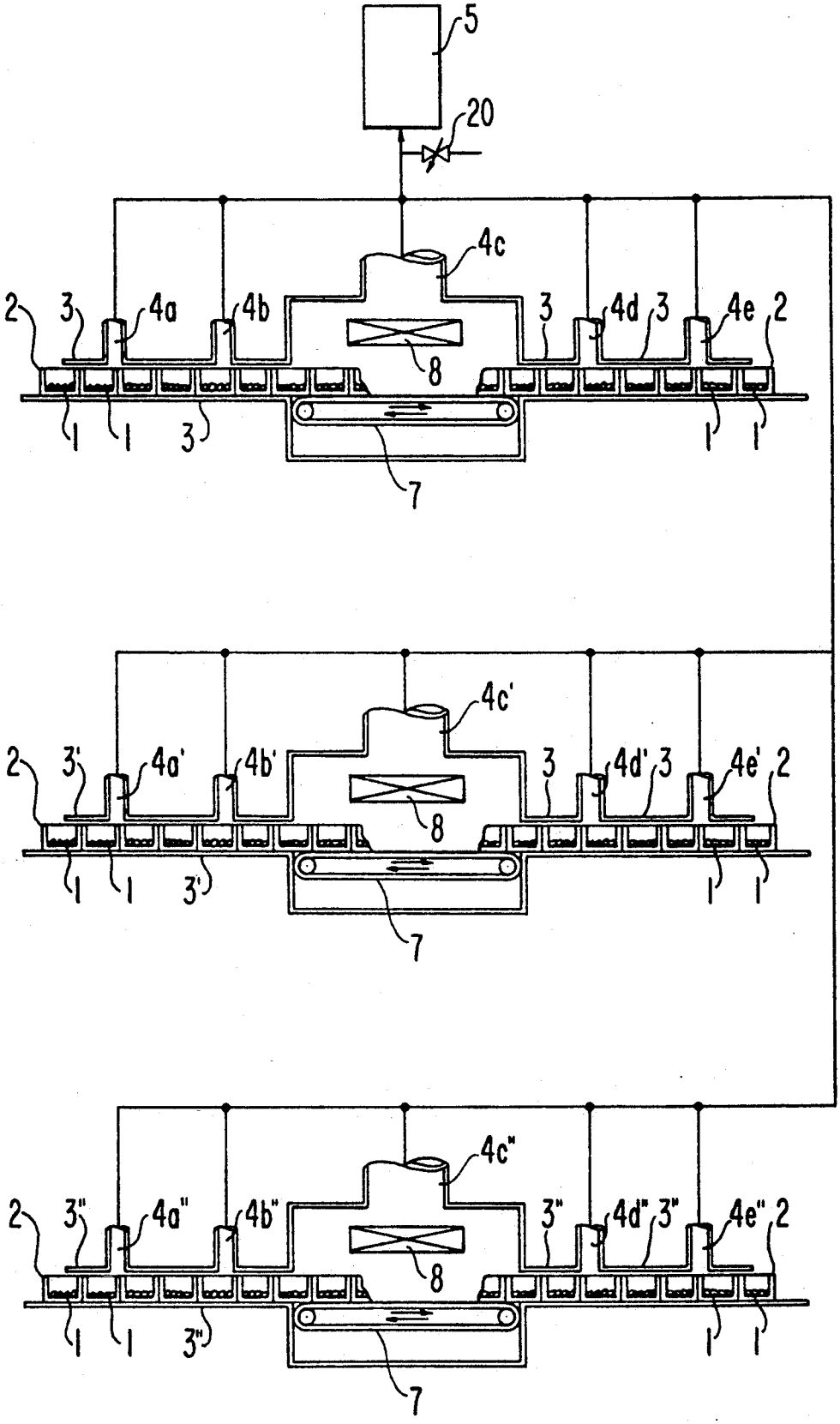
FIG. 5 is a longitudinal cross-sectional view of a fourth preferred embodiment of the present invention.

Also, it is a matter of course that the cylindrical casing and the cylindrical containers in this preferred embodiment are equally applicable to the second preferred embodiment having a U-shaped casing shown in FIG. 5 or to the third preferred embodiment having a circular-grate-shaped casing shown in FIGS. 6 to 8.

Figure 17:
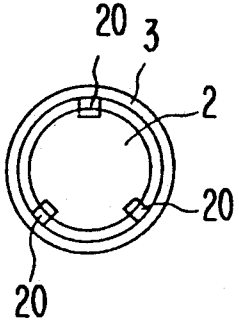
FIG. 17 is a side view of the same.
Figure 16:
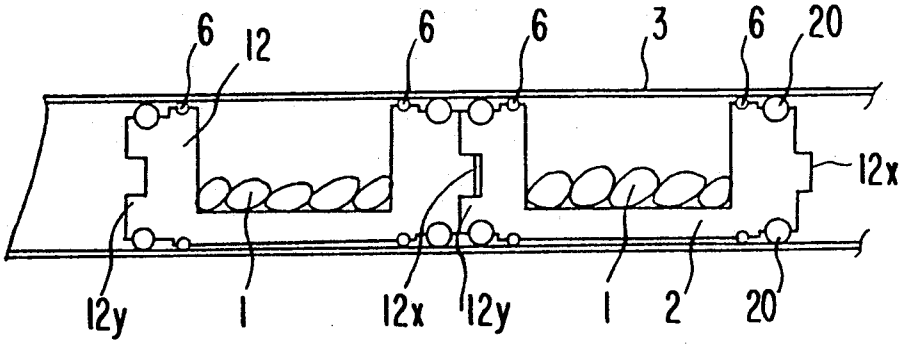
FIG. 16 is a longitudinal cross-sectional view of a ninth preferred embodiment of the present invention.
Figure 18:
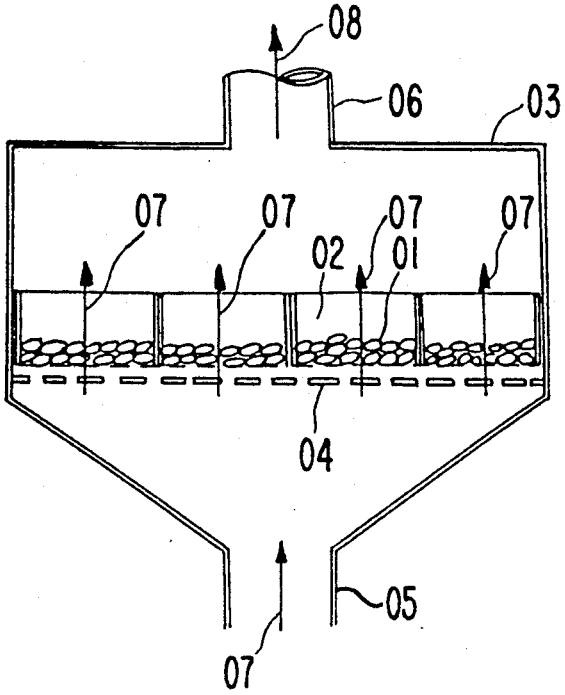
FIG. 18 (PRIOR ART)
FIG. 18 is a longitudinal cross-sectional view of a hot air drying system in the prior art.
Figure 19:
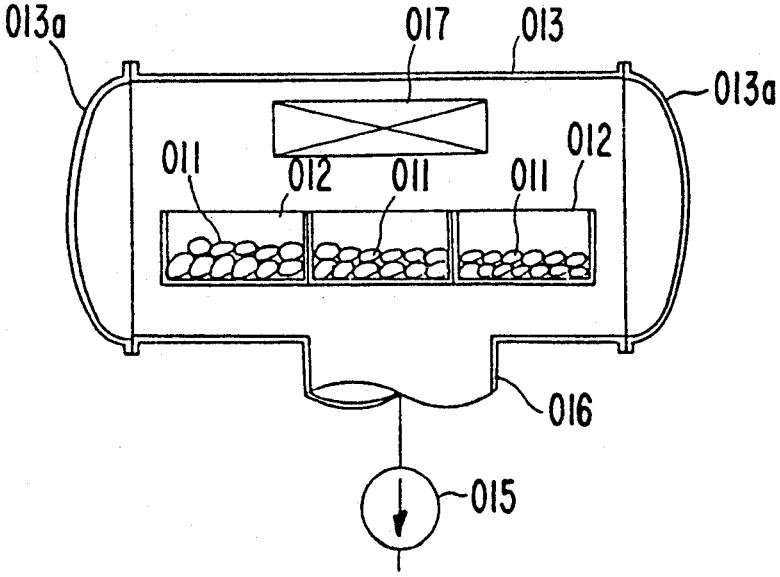
FIG. 19 (PRIOR ART)
FIG. 19 is a longitudinal cross-sectional view of a vacuum drying system in the prior art.

Next, a ninth preferred embodiment of the present invention will be explained with reference to FIGS. 16 and 17. In this preferred embodiment, in order to prevent the O-rings 6 around the containers 2 of the above-described eighth preferred embodiment, especially at their lower portions, from being heavily loaded and thus unevenly worn, as shown in FIG. 17 three guide rollers 20 held in contact with the inner surface of the cylindrical casing 3 are provided at equal angular intervals on the outer circumferences of the front and rear walls 12A and 12B of the container 2. Owing to the above-mentioned provision, the weight of the container 2 and the articles to be dried 1 are supported by the guide rollers 20, and therefore, the O-ring 6 can be prevented from being heavily loaded and unevenly worn. It is to be noted that while the guide rollers 20 are provided around the front and rear wall surfaces 12A and 12B of the container 2 in the illustrated embodiment, a modification could be made such that the guide rollers 20 may be provided on the inner surface of the cylindrical casing 3.

In the above-described respective embodiments, it be preferable that the container 2 is made of materials having a low specific inductivity and a low dielectric power factor such as fluorine resin, polypropylene resin, polyethylene resin, vinyl chloride resin, polycarbonate resin, quartz glass, porcelain or the like. In addition, with regard to the O-rings 6, in order to improve sliding characteristics, it is preferable that those having caps made of polyethylene resin or fluorine resin at the contact portions with the casing 3 are employed or a lining of fluorine resin or polyethylene resin is applied to the inner surface of the casing. Also it is preferable to use material having a lining of fluorine resin or the like for the O-ring 6 itself to give it the properties of wearresistance and low friction.

Furthermore, in the above-described respective embodiments, in order to feed the containers 2 to a container driving device, such as the belt conveyor 7, or to take them from the container driving device, such as the belt conveyor 7, for instance, an air-cylinder or a motor-cylinder can be used.

As will be obvious from the detailed description of the preferred embodiments of the present invention, discontinuous articles such as pellets, bulk sheets or the like can be vacuumtreated while they are being continuously fed from the atmosphere into a vacuum or, on the contrary, while they are being continuously discharged from vacuum to the atmosphere. Accordingly, an efficiency of the vacuum-treatment of discontinuous articles is improved, hence a productivity can be enhanced to twice that or more of similar system in the prior art on an approximately equal scale, and furthermore, as a result of continuous version of vacuum treatment, the vacuum treatment system can be connected with the preceding and succeeding steps of the treatment. Moreover, according to the present invention, the system incorporating the aforementioned functions can be realized in a compact scale and cheaply without increasing a capacity of a vacuum evacuation facility.

While a principle of the present invention has been described above in connection with a number of preferred embodiments of the invention, it is a matter of course that many apparently widely different embodiments of the present invention could be made without departing from the spirit of the present invention.

What is claimed is:

1. A continuous vacuum treatment system comprising: containers for accommodating articles to be treated, said containers having front and rear walls, said walls extending transversely to the direction of movement of the containers through said casing, and said walls having through-holes extending therethrough, a tunnel-like casing in which a plurality of said containers can move contiguously, a driving device for moving said containers in said casing, a plurality of evacuation ducts open to said casing at locations spaced by intervals each longer than the length of each of said containers as taken between the walls thereof, seal devices for sealing clearances between the outer surfaces of said containers and the inner surface of said casing at positions between said locations at which the ducts are open to said casing, and an evacuation facility for evacuating the inside of said casing in a stepwise manner through said plurality of evacuation ducts.

2. A continuous vacuum treatment system as claimed in claim 1, wherein said tunnel-like casing extends linearly.

3. A continuous vacuum treatment system as claimed in claim 1, and further comprising rollers provided between the outer surface of said containers and the inner surface of said casing.

4. A continuous vacuum treatment system as claimed in claim 3, and further comprising means, in the front and rear walls of adjacent ones of said containers, for preventing said adjacent ones of the containers from rotating relative to one another.

5. A continuous vacuum treatment system as claimed in claim 1, wherein said tunnel-like casing has a circular cross section, and said containers also have a circular cross section.

6. A continuous vacuum treatment system comprising: containers for accommodating articles to be treated, aid containers having front and rear walls, a tunnel-like casing in which a plurality of said containers can move contiguously, a driving device for moving said containers in said casing, a plurality of evacuation ducts open to said casing at locations spaced by intervals each longer than the length of each of said containers as taken between the walls thereof, seal devices for sealing clearances between the outer surfaces of said containers and the inner surface of said casing at positions between said locations at which the ducts are open to said casing, an evacuation facility for evacuating the inside of said casing in a stepwise manner through said plurality of evacuation ducts, and means, in the front and rear walls of adjacent ones of said containers, for preventing said adjacent ones of said containers from rotating relative to one another.

7. A continuous vacuum treatment system as claimed in claim 6, and further comprising rollers provided between the outer surface of said containers and the inner surface of said casing.

8. A continuous vacuum treatment system as claimed in claim 6, wherein said tunnel-like casing extends linearly.

9. A continuous vacuum treatment system as claimed in claim 6, wherein the walls extend transversely to the direction of movement of the containers through said casing, and said walls have through-holes extending therethrough.

10. A continuous vacuum treatment system as claimed in claim 6, wherein said tunnel-like casing has a circular cross section, and said containers also have a circular cross section.

* * * * *